US011217168B2

(12) United States Patent
Xu

(10) Patent No.: US 11,217,168 B2
(45) Date of Patent: Jan. 4, 2022

(54) DISPLAY PANEL INCLUDING SHORT CIRCUIT PROTECTION CIRCUIT

(71) Applicant: SeeYA Optronics Co., Ltd., Shanghai (CN)

(72) Inventor: Wenwei Xu, Shanghai (CN)

(73) Assignee: SeeYA Optronics Co., Ltd., Shanghai (CN)

( * ) Notice: Subject to any disclaimer, the term of this patent is extended or adjusted under 35 U.S.C. 154(b) by 0 days.

(21) Appl. No.: 17/026,959

(22) Filed: Sep. 21, 2020

(65) Prior Publication Data

US 2021/0201780 A1 Jul. 1, 2021

(30) Foreign Application Priority Data

Dec. 31, 2019 (CN) ..... 201911417479.8

(51) Int. Cl.
*G09G 3/3233* (2016.01)
*G09G 3/00* (2006.01)

(52) U.S. Cl.
CPC ..... *G09G 3/3233* (2013.01); *G09G 3/006* (2013.01); *G09G 2300/0809* (2013.01); *G09G 2330/04* (2013.01)

(58) Field of Classification Search
CPC ..... G09G 3/3233; G09G 3/006; G09G 2300/0809; G09G 2330/04; G09G 3/3225
See application file for complete search history.

(56) References Cited

U.S. PATENT DOCUMENTS

2009/0309863 A1 12/2009 Seto
2019/0005881 A1* 1/2019 Yue ..... G09G 3/3241
2019/0122616 A1 4/2019 Lee et al.

FOREIGN PATENT DOCUMENTS

CN 101276528 10/2008
CN 106486041 3/2017
CN 106531071 3/2017
CN 106683605 5/2017
CN 206271397 6/2017
CN 206301580 7/2017
CN 107516483 12/2017
(Continued)

OTHER PUBLICATIONS

First Office Action in CN related case App 201911417479.8.

*Primary Examiner* — Mark W Regn
(74) *Attorney, Agent, or Firm* — W&G Law Group

(57) ABSTRACT

The present disclosure provides a display panel. The display panel includes a short circuit protection circuit, a pixel driving circuit, and an organic light-emitting element. The short circuit protection circuit includes a detection circuit electrically connected to the organic light-emitting element, and a control circuit electrically connected to the detection circuit and the pixel driving circuit. The detection circuit is configured to detect whether the organic light-emitting element is short-circuited. The control circuit is configured to control, in response to a detection result of the detection circuit, whether the pixel driving circuit performs driving. In the present disclosure, the display panel includes a plurality of pixel units arranged in rows and columns. This prevents the pixel driving circuit from burning the organic light-emitting element that is short-circuited or other adjacent organic light-emitting element.

10 Claims, 14 Drawing Sheets

(56) References Cited

FOREIGN PATENT DOCUMENTS

| | | |
|---|---|---|
| CN | 108682385 | 10/2018 |
| CN | 110580876 | 12/2019 |
| KR | 20170064163 | 6/2017 |

* cited by examiner

DISPLAY PANEL INCLUDING SHORT CIRCUIT PROTECTION CIRCUIT

CROSS-REFERENCE TO RELATED APPLICATIONS

The present application claims priority to Chinese Patent Application No. 201911417479.8, filed on Dec. 31, 2019, the contents of which are incorporated herein by reference in its entirety.

TECHNICAL FIELD

The present disclosure relates to the field of display technologies, and in particular, to a display panel including a short circuit protection circuit.

BACKGROUND

In the display technologies, organic light emitting diodes (OLED) have recognized, by the industry as a third generation of display technology following a liquid crystal display (LCD) technology due to advantages such as being light and thin, self-luminous, high response speed, wide viewing angle, being rich in color, high brightness, low power consumption, high/low temperature resistance, etc.

SUMMARY

In order to solve the above technical problems, the present disclosure provides a display panel, including a short circuit protection circuit, a pixel driving circuit, and an organic light-emitting element. The short circuit protection circuit includes a detection circuit electrically connected to the organic light-emitting element, and a control circuit electrically connected to the detection circuit and the pixel driving circuit. The detection circuit is configured to detect whether the organic light-emitting element is short-circuited. The control circuit is configured to control, in response to a detection result of the detection circuit, whether the pixel driving circuit performs driving.

In the present disclosure, the display panel includes a plurality of pixel units that is arranged in a plurality of rows and a plurality of columns. Each pixel unit includes a short circuit protection circuit, a pixel driving circuit, and an organic light-emitting element. In one pixel unit, the detection circuit is configured to detect whether the organic light-emitting element is short-circuited. The control circuit is configured to control, in response to a detection result of the detection circuit, whether the pixel driving circuit performs driving. When the detection circuit detects that the organic light-emitting element is short-circuited, the control circuit controls, in response to the detection result of the detection circuit, the pixel driving circuit not to output a driving current. This prevents the pixel driving circuit from outputting an extremely large current to the organic light-emitting element that is short-circuited or other adjacent organic light-emitting element. Thus, this prevents the pixel driving circuit from burning the organic light-emitting element that is short-circuited or other adjacent organic light-emitting element. When the detection circuit detects that the organic light-emitting element is not short-circuited, the control circuit controls, in response to the detection result of the detection circuit, the pixel driving circuit to output a driving current. In this case, the pixel driving circuit drives the organic light-emitting element to emit light.

BRIEF DESCRIPTION OF DRAWINGS

In order to more clearly illustrate technical solutions in embodiments of the present disclosure, the accompanying drawings used in the embodiments are briefly introduced as follows. It should be noted that the drawings described as follows are merely part of the embodiments of the present disclosure, and other drawings can also be acquired by those skilled in the art without paying creative efforts.

DESCRIPTION OF EMBODIMENTS

In order to better understand technical solutions of the present disclosure, the embodiments of the present disclosure will be described in details with reference to the drawings.

It should be clear that the described embodiments are merely part of the embodiments of the present disclosure rather than all of the embodiments. All other embodiments obtained by those skilled in the art without paying creative labor shall fall into the protection scope of the present disclosure.

Figure 1:
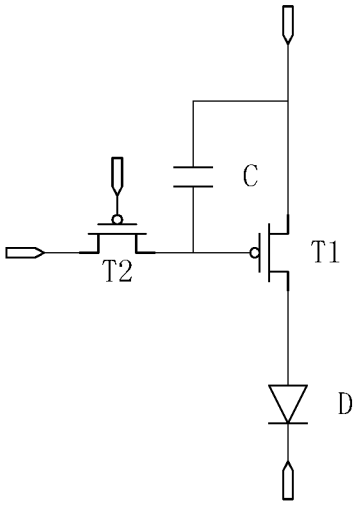
FIG. 1 (Prior Art)
FIG. 1 is a circuit diagram of a pixel unit of a display panel in the related art.

FIG. 1 is a circuit diagram of a pixel unit of a display panel in the related art.

Figure 2:
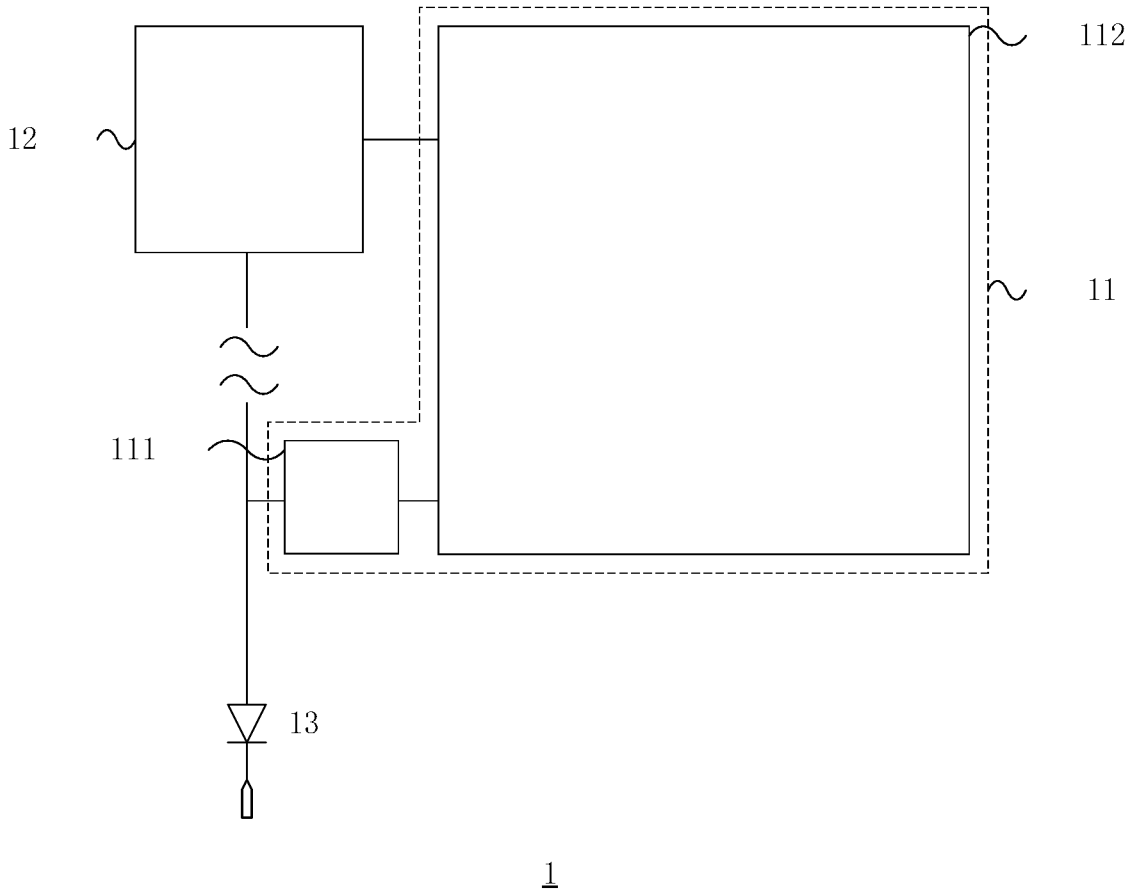
FIG. 2 is a first circuit diagram of a pixel unit of a display panel according to an embodiment of the present disclosure.

As shown in FIG. 1, in the related art, a pixel unit of a display panel includes a driving transistor T1, a switching transistor T2, a bootstrap capacitor C, and an organic light-emitting element D. When the organic light-emitting element D is not short-circuited, a driving current for driving the driving transistor T1 is normal. In this case, the driving current of the driving transistor T1 flows through the organic light-emitting element D. The driving transistor T1 drives the organic light-emitting element D to emit light. When the organic light-emitting element D is short-circuited, the driving current of the driving transistor T1 is extremely large. In this case, the excessively large current of the driving transistor T1 flows through the organic light-emitting element D that is short-circuited. The excessively large current of the driving transistor T1 will burn the organic light-emitting element D that is short-circuited. Moreover, the display panel includes a plurality of pixel units. One pixel unit is adjacent to another pixel unit, and one organic light-emitting element D is adjacent to another organic light-emitting element D. Therefore, the excessively large current of the driving transistor T1 flows through not only the organic light-emitting element D that is short-circuited but also the adjacent organic light-emitting element D. Thus, the excessively large current of the driving transistor T1 not only burns the organic light-emitting element D that is short-circuited, but also burns the adjacent organic light-emitting element D. FIG. 2 is a first circuit diagram of a pixel unit of a display panel according to an embodiment of the present disclosure.

As shown in FIG. 2, the display panel 1 includes a short circuit protection circuit 11, a pixel driving circuit 12, and an organic light-emitting element 13. The short circuit protection circuit 11 includes a detection circuit 111 and a control circuit 112. The detection circuit 111 is electrically connected to the organic light-emitting element 13, and the control circuit 112 is electrically connected to the detection circuit 111 and the pixel driving circuit 12. The detection circuit 111 is configured to detect whether the organic light-emitting element 13 is short-circuited. The control circuit 112 is configured to control, in response to a detection result of the detection circuit 111, whether the pixel driving circuit 12 performs driving.

The pixel driving circuit 12 is electrically connected to the organic light-emitting element 13. When the pixel driving circuit 12 outputs a driving current to the organic light-emitting element 13, the pixel driving circuit 12 drives the organic light-emitting element 13 to emit light. When the pixel driving circuit 12 does not output a driving current to the organic light-emitting element 13, the pixel driving circuit 12 does not drive the organic light-emitting element 13 to emit light.

Figure 3:
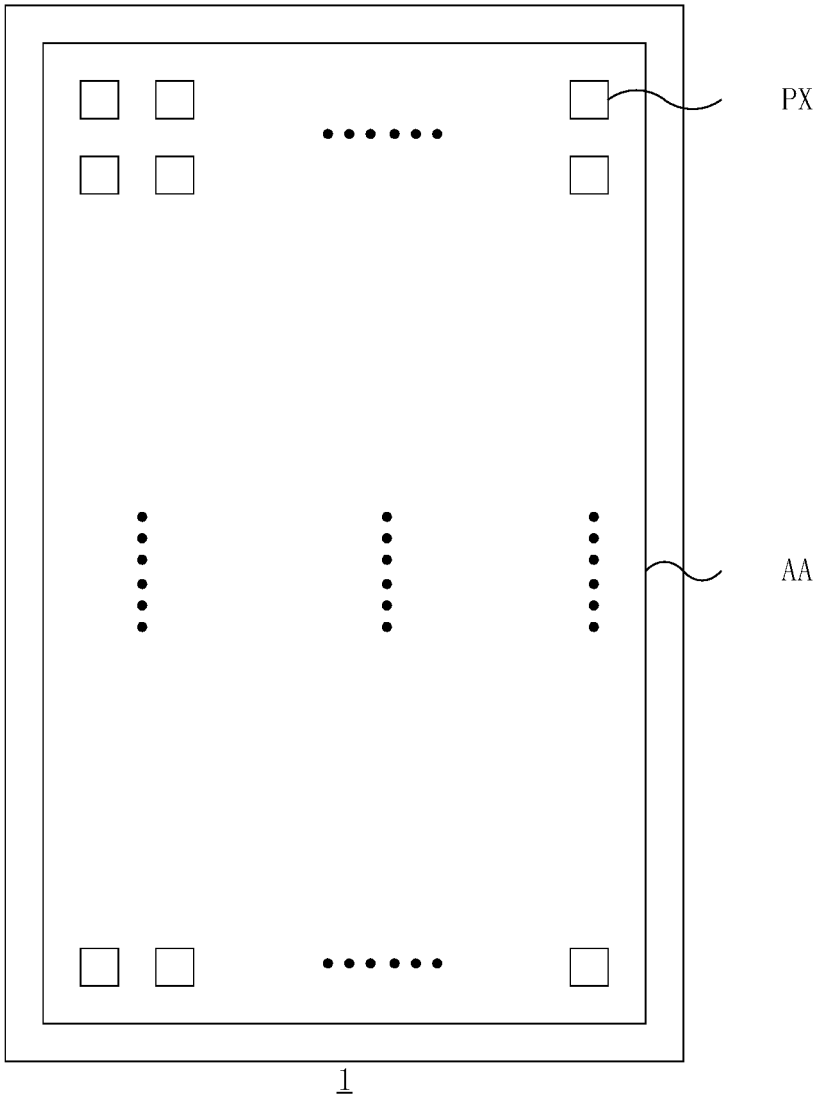
FIG. 3 is a structural schematic diagram of a display area of a display panel according to an embodiment of the present disclosure.

FIG. 3 is a structural schematic diagram of a display area of a display panel according to an embodiment of the present disclosure.

As shown in FIG. 3, the display panel 1 has a display area AA provided with pixel units PX, and the pixel units PX are arranged in a plurality of rows and a plurality of columns. When each of the pixel units PX individually performs displaying, an image is displayed in the display area AA of the display panel 1. One of the pixel units PX includes a short circuit protection circuit 11, a pixel driving circuit 12, and an organic light-emitting element 13. The short circuit protection circuit 11, the pixel driving circuit 12, and the organic light-emitting element 13 are shown in FIG. 2. Herein, one pixel unit PX is adjacent to another pixel unit PX, and one organic light-emitting element 13 is adjacent to another organic light-emitting element 13.

In one pixel unit PX, the detection circuit 111 is configured to detect whether the organic light-emitting element 13 is short-circuited. The control circuit 112 is configured to control, in response to the detection result of the detection circuit 111, whether the pixel driving circuit 12 performs driving. When the detection circuit 111 detects that the organic light-emitting element 13 is short-circuited, the control circuit 112 controls, in response to the detection result of the detection circuit 111, the pixel driving circuit 12 not to output a driving current. This prevents the pixel driving circuit 12 from outputting an extremely large current to the organic light-emitting element 13 that is short-circuited or other adjacent organic light-emitting element 13. Thus, this prevents the pixel driving circuit 12 from burning the organic light-emitting element 13 that is short-circuited or other adjacent organic light-emitting element 13. When the detection circuit 111 detects that the organic light-emitting element 13 is not short-circuited, the control circuit 112 controls, in response to the detection result of the detection circuit 111, the pixel driving circuit 12 to output a driving current. In this case, the pixel driving circuit 12 drives the organic light-emitting element 13 to emit light. Then, the display panel 1 may display an image by using the organic light-emitting elements 13.

Figure 4:
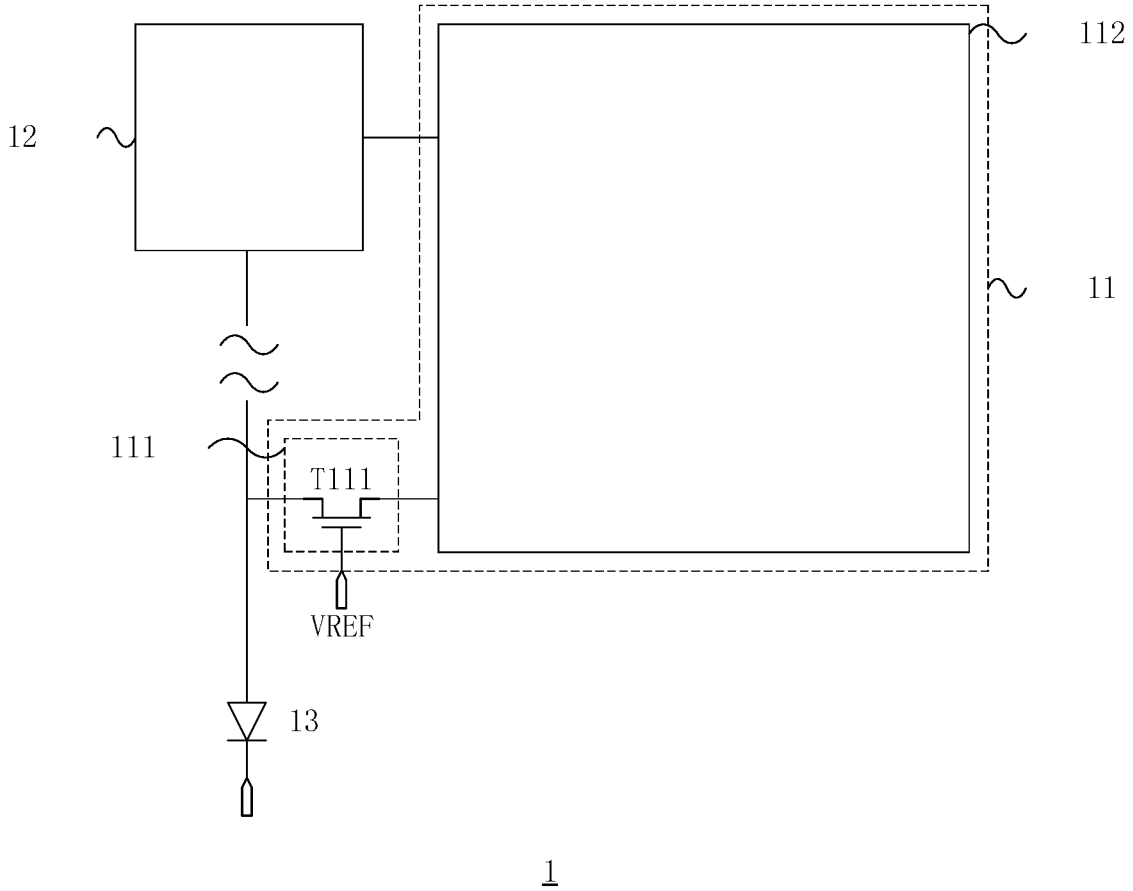
FIG. 4 is a second circuit diagram of a pixel unit of a display panel according to an embodiment of the present disclosure.

FIG. 4 is a second circuit diagram of a pixel unit of a display panel according to an embodiment of the present disclosure;

As shown in FIG. 4, the detection circuit 111 includes a first transistor T111. The first transistor T111 includes a control electrode electrically connected to a reference signal VREF, a first electrode electrically connected to the organic light-emitting element 13, and a second electrode electrically connected to the control circuit 112.

A part in the circuit shown in FIG. 4 other than the detection circuit 111 is the same as that in the circuit shown in FIG. 2, and thus will not be further described herein.

The first transistor T111 is an N-type transistor. The control electrode, the first electrode, and the second electrode of the first transistor T111 are respectively a gate electrode, a source electrode, and a drain electrode of the first transistor T111. The gate electrode of the first transistor T111 is electrically connected to the reference signal VREF. The source electrode of the first transistor T111 is electrically connected to an anode of the organic light-emitting element 13. If the organic light-emitting element 13 is short-circuited, a potential of the anode of the organic light-emitting element 13 will be equal to a potential of a cathode of the organic light-emitting element 13. In this case, a potential of the gate electrode of the first transistor T111 is equal to a potential of the reference signal VREF. A potential of the source electrode of the first transistor T111 is equal to the potential of the anode of the organic light-emitting element 13, and is also equal to the potential of the cathode of the organic light-emitting element 13. Agate-source voltage of the first transistor T111 is equal to a difference between the potential of the reference signal VREF and the potential of the cathode of the organic light-emitting element 13. The difference between the potential of the reference signal VREF and the potential of the cathode of the organic light-emitting element 13 is set to be higher than a threshold voltage of the first transistor T111. Thus, the first transistor T111 is turned on due to the gate-source voltage being higher than the threshold voltage. If the organic light-emitting element 13 is not short-circuited, the potential of the anode of the organic light-emitting element 13 is equal to a sum of the potential of the cathode of the organic light-emitting element 13 and the threshold voltage of the organic light-emitting element 13. The gate-source voltage of the first transistor T111 is equal to a result of subtracting the sum of the potential of the cathode of the organic light-emitting element 13 and the threshold voltage of the organic light-emitting element 13 from the potential of the reference signal VREF. The result of subtracting the sum of the potential of the cathode of the organic light-emitting element 13 and the threshold voltage of the organic light-emitting element 13 from the potential of the reference signal VREF is set to be smaller than zero. Thus, the first transistor T111 is turned off due to the gate-source voltage being smaller than zero. Therefore, an on/off state of the first transistor T111 may indicate whether the organic light-emitting element 13 is short-circuited. The drain electrode of the first transistor T111 is electrically connected to the control circuit 112. Thus, the control circuit 112 can obtain the on/off state of the first transistor T111, thereby determining whether the organic light-emitting element 13 is short-circuited.

Figure 5:
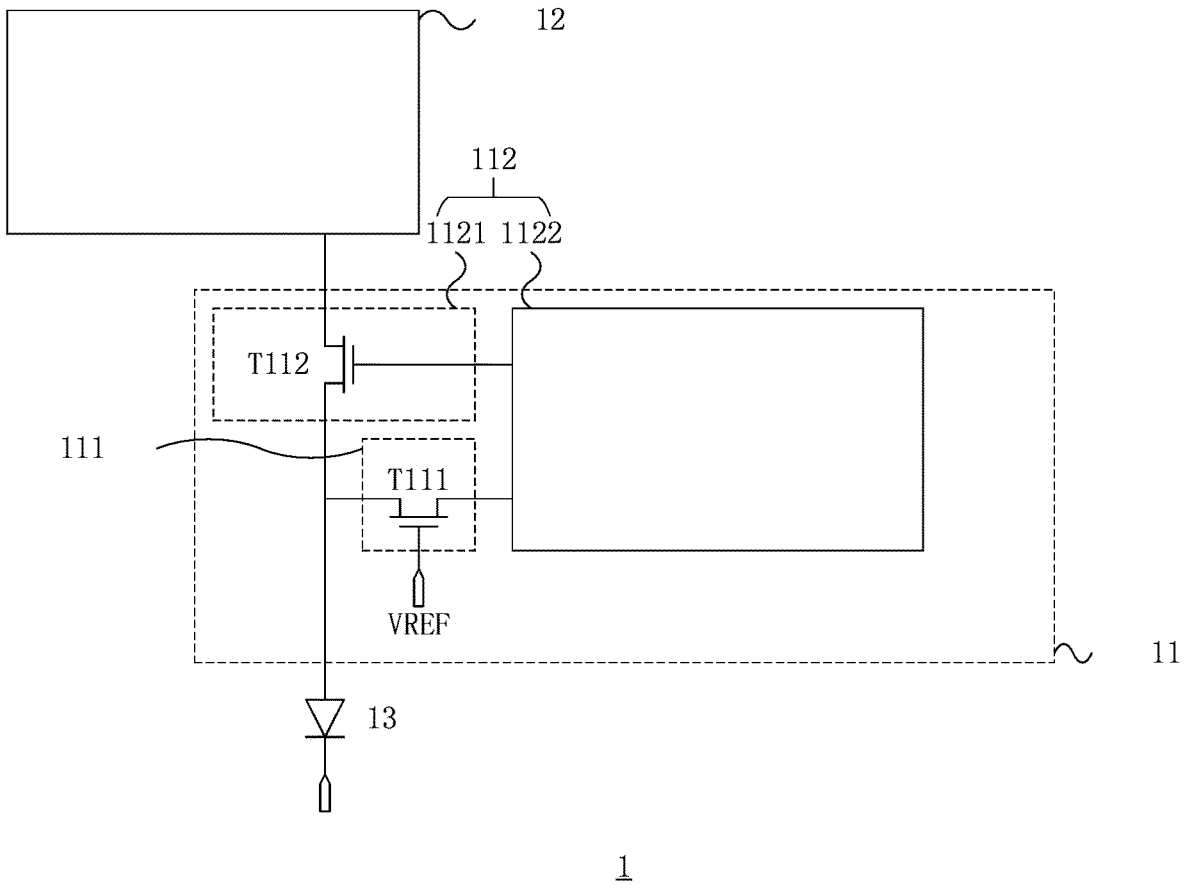
FIG. 5 is a third circuit diagram of a pixel unit of a display panel according to an embodiment of the present disclosure.

FIG. 5 is a third circuit diagram of a pixel unit of a display panel according to an embodiment of the present disclosure.

As shown in FIG. 5, the control circuit 112 includes a first control unit 1121. The first control unit 1121 includes a second transistor T112. The second transistor T112 includes a first electrode electrically connected to the pixel driving circuit 12, and a second electrode electrically connected to the organic light-emitting element 13.

A part other than the control circuit 112 in the circuit shown in FIG. 5 is the same as a that in the circuit shown in FIG. 4, and thus will not be further described herein.

The second transistor T112 includes a control electrode, a first electrode, and a second electrode, which are respectively a gate electrode, a source electrode, and a drain electrode of the second transistor T112. The source electrode of the second transistor T112 is electrically connected to the pixel driving circuit 12, and the drain electrode of the second transistor T112 is electrically connected to the organic light-emitting element 13. When the first transistor T111 detects that the organic light-emitting element 13 is short-circuited, the second transistor T112 is turned off in response to the detection result of the first transistor T111, so that the pixel driving circuit 12 does not output a driving current. In this case, the second transistor T112 prevents the driving current of the pixel driving circuit 12 from burning the organic light-emitting element 13. When the first transistor T111 detects that the organic light-emitting element 13 is not short-circuited, the second transistor T112 is turned on in response to the detection result of the first transistor T111, so that the pixel driving circuit 12 outputs a driving current. In this case, the pixel driving circuit 12 drives the organic light-emitting element 13 to emit light.

Figure 6:
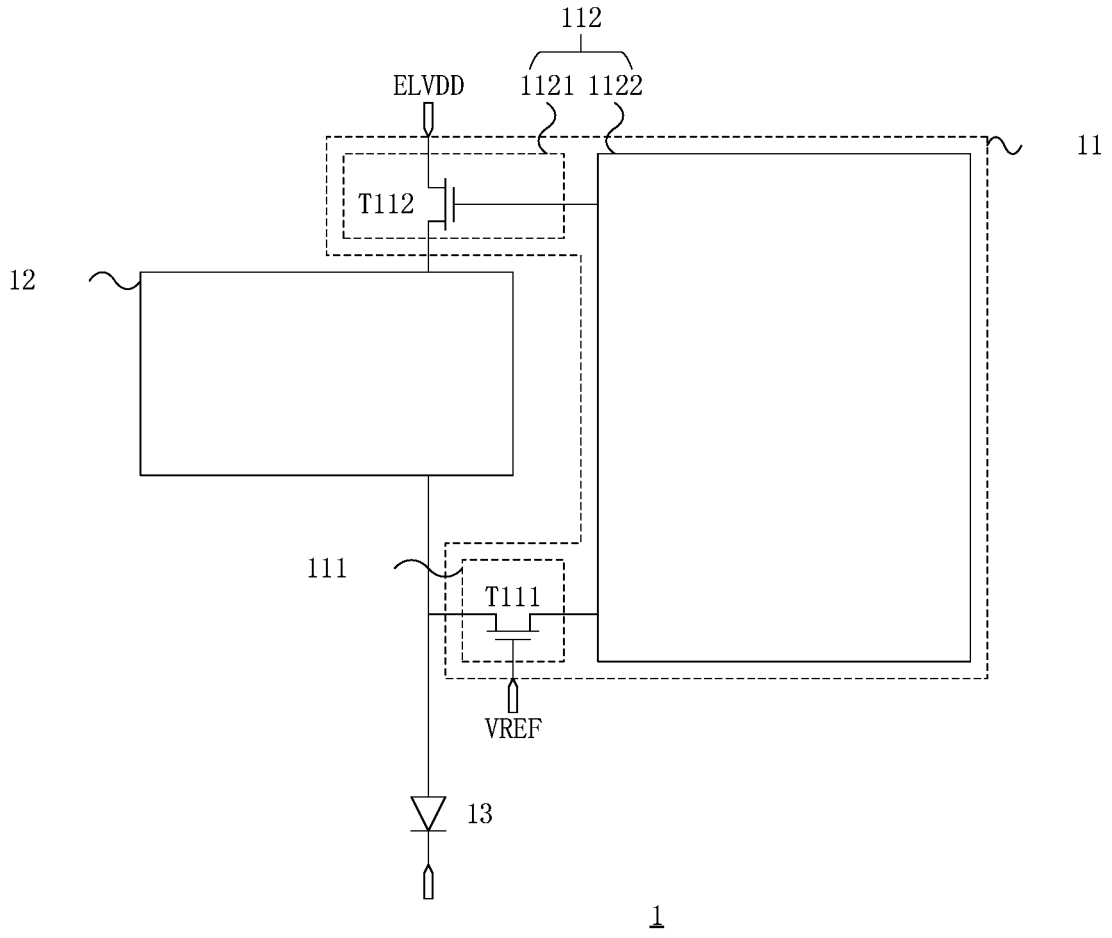
FIG. 6 is a fourth circuit diagram of a pixel unit of a display panel according to an embodiment of the present disclosure.

FIG. 6 is a fourth circuit diagram of a pixel unit of a display panel according to an embodiment of the present disclosure As shown in FIG. 6, the control circuit 112 includes a first control unit 1121. The first control unit 1121 includes a second transistor T112. The second transistor T112 includes a first electrode electrically connected to a first power supply signal ELVDD, and a second electrode electrically connected to the pixel driving circuit 12.

A part other than the control circuit 112 in the circuit shown in FIG. 6 is the same as that in the circuit shown in FIG. 4, and thus will not be further described herein.

The second transistor T112 includes a control electrode, a first electrode, and a second electrode, which are respectively a gate electrode, a source electrode, and a drain electrode of the second transistor T112. The source electrode of the second transistor T112 is electrically connected to the first power supply signal ELVDD, and the drain electrode of the second transistor T112 is electrically connected to the pixel driving circuit 12. When the first transistor T111 detects that the organic light-emitting element 13 is short-circuited, the second transistor T112 is turned off in response to the detection result of the first transistor T111, so that the pixel driving circuit 12 does not output a driving current. In this case, the second transistor T112 prevents the driving current of the pixel driving circuit 12 from burning the organic light-emitting element 13. When the first transistor T111 detects that the organic light-emitting element 13 is not short-circuited, the second transistor T112 is turned on in response to the detection result of the first transistor T111, so that the pixel driving circuit 12 outputs a driving current. In this case, the pixel driving circuit 12 drives the organic light-emitting element 13 to emit light.

Figure 7:
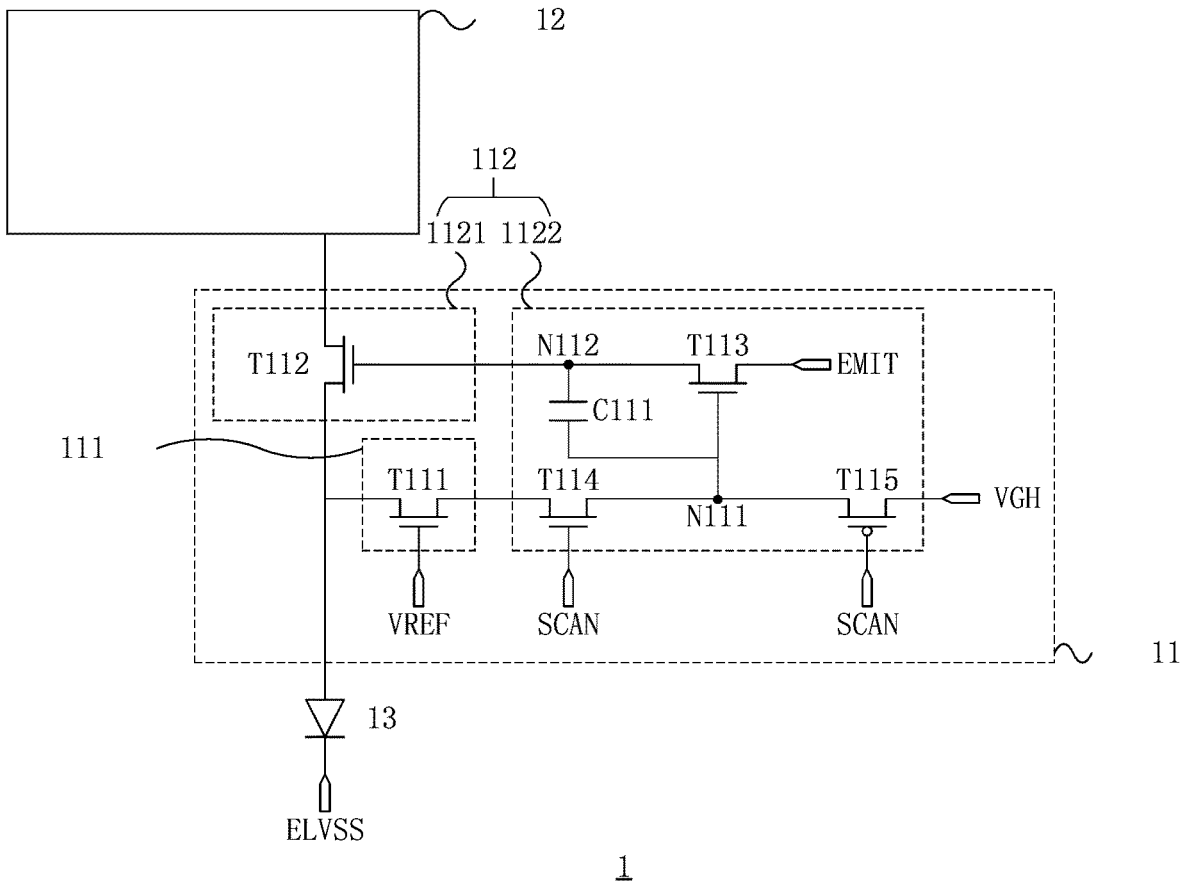
FIG. 7 is a fifth circuit diagram of a pixel unit of a display panel according to an embodiment of the present disclosure.
Figure 8:
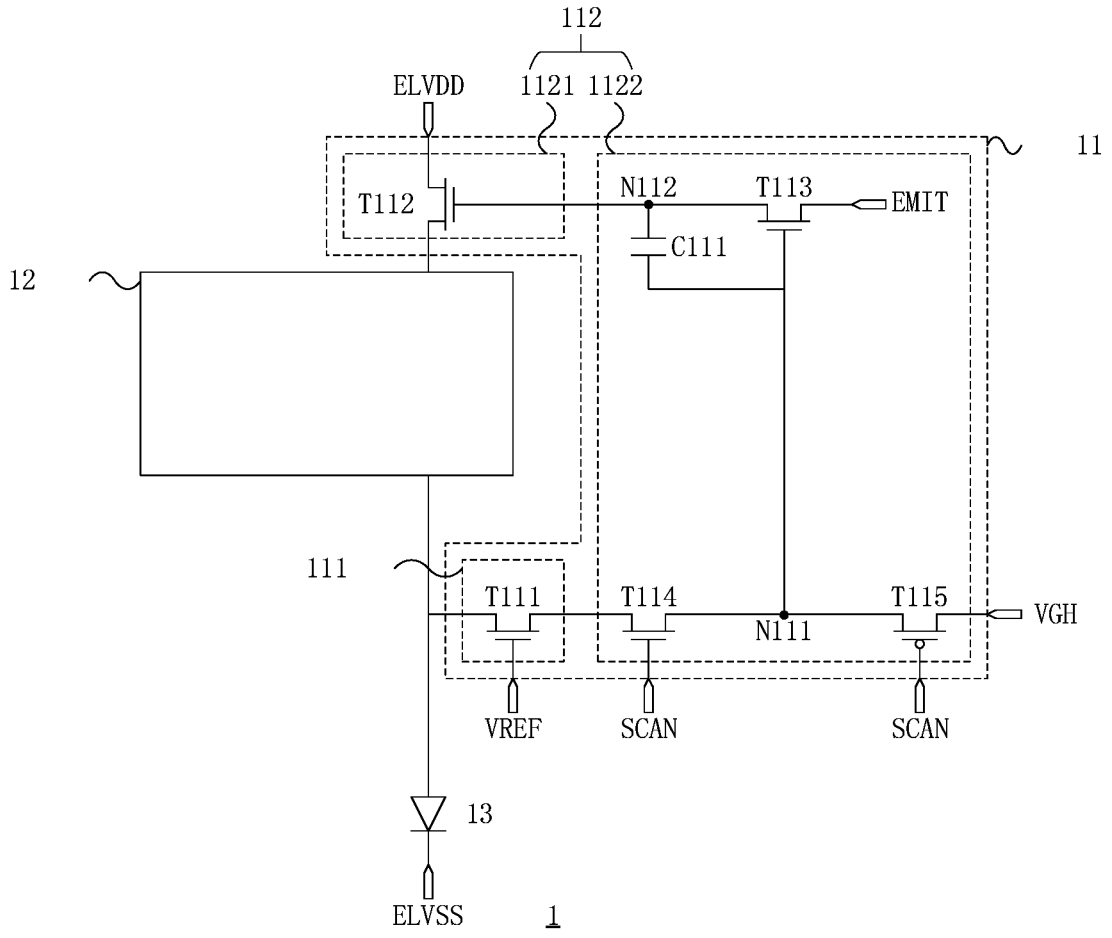
FIG. 8 is a sixth circuit diagram of a pixel unit of a display panel according to an embodiment of the present disclosure.

FIG. 7 is a fifth circuit diagram of a pixel unit of a display panel according to an embodiment of the present disclosure. FIG. 8 is a sixth circuit diagram of a pixel unit of a display panel according to an embodiment of the present disclosure.

As shown in FIG. 7 and FIG. 8, the control circuit 112 further includes a second control unit 1122. The second control unit 1122 includes a third transistor T113, a fourth transistor T114, a fifth transistor T115, a first capacitor C111, a first node N111, and a second node N112. The third transistor T113 includes a control electrode electrically connected to the first node N111, a first electrode electrically connected to the second node N112, and a second electrode electrically connected to a light-emitting signal EMIT. The fourth transistor T114 includes a control electrode electrically connected to a scan signal SCAN, a first electrode electrically connected to the second electrode of the first transistor T111, and a second electrode electrically connected to the first node N111. The fifth transistor T115 includes a control electrode electrically connected to the scan signal SCAN, a first electrode electrically connected to the first node N111, and a second electrode electrically connected to a high-potential signal VGH. The first capacitor C111 includes a first electrode electrically connected to the second node N112, and a second electrode electrically connected to the first node N111.

The second control unit 1122 in the circuit shown in FIG. 7 is the same as the second control unit 1122 in the circuit shown in FIG. 8. This part will be described uniformly. A part other than the second control unit 1122 in the circuit shown in FIG. 7 is the same as that in the circuit shown in FIG. 5, and will not be further described herein. A part other than the second control unit 1122 in the circuit shown in FIG. 8 is the same as that in the circuit shown in FIG. 6, and will not be further described herein.

A connection relation of the pixel driving circuit 12 in the circuit shown in FIG. 7 is different from a connection relation of the pixel driving circuit 12 in the circuit shown in FIG. 8. The connection relation of the pixel driving circuit 12 in the circuit shown in FIG. 7 is the same as the connection relation of the pixel driving circuit 12 in the circuit shown in FIG. 5. This part has been described above and will not be repeated herein. The connection relation of the pixel driving circuit 12 in the circuit shown in FIG. 8 is the same as that in the circuit shown in FIG. 6. This part has been described above and will not be repeated herein.

In the second control unit 1122, the control electrode, the first electrode, and the second electrode of each of the third transistor T113, the fourth transistor T114, and the fifth transistor T115 are respectively a gate electrode, a source electrode, and a drain electrode thereof. The second control unit 1122 is electrically connected to the drain electrode of the first transistor T111 and the gate electrode of the second transistor T112. When the first transistor T111 detects that the organic light-emitting element 13 is short-circuited, the second control unit 1122 controls, in response to the detection result of the first transistor T111, the second transistor T112 to be turned off. When the first transistor T111 detects that the organic light-emitting element 13 is not short-circuited, the second control unit 1122 controls, in response to the detection result of the first transistor T111, the second transistor T112 to be turned on.

As shown in FIG. 7 and FIG. 8, the organic light-emitting element 13 includes a first electrode electrically connected to the first transistor T111, and a second electrode electrically connected to a second power supply signal ELVSS. The potential of the reference signal VREF is greater than a sum of a potential of the second power supply signal ELVS and the threshold voltage of the first transistor T111, and smaller than a sum of the potential of the second power supply signal ELVSS and the threshold voltage of the organic light-emitting element 13.

A relation between the reference signal VREF and the second power supply signal ELVSS in the circuit shown in FIG. 7 is the same as that in the circuit shown in FIG. 8. This part will be described uniformly.

The first electrode and the second electrode of the organic light-emitting element 13 are respectively an anode and a cathode of the organic light-emitting element 13. The anode electrode of the organic light-emitting element 13 is electrically connected to the source electrode of the first transistor T111, and the cathode of the organic light-emitting element 13 is electrically connected to the second power supply signal ELVSS. If the organic light-emitting element 13 is short-circuited, it will cause the potential of the anode or the source electrode of the first transistor T111 to be equal to the potential of the second power supply signal ELVS S. The potential of the gate electrode of the first transistor T111 is equal to the potential of the reference signal VREF. The gate-source voltage of the first transistor T111 is equal to a difference between the potential of the reference signal VREF and the potential of the second power supply signal ELVSS. The difference between the potential of the reference signal VREF and the potential of the second power supply signal ELVSS is greater than the threshold voltage of the first transistor T111. The first transistor T111 is an N-type transistor. Thus, the first transistor T111 is turned on in response to the gate-source voltage being higher than the threshold voltage. If the organic light-emitting element 13 is not short-circuited, the potential of the anode of the organic light-emitting element 13 or the potential of the source electrode of the first transistor T111 is equal to a sum of the potential of the cathode of the organic light-emitting element 13 and the threshold voltage of the organic light-emitting element 13. The potential of the gate electrode of the first transistor T111 is equal to the potential of the reference signal VREF. The gate-source voltage of the gate electrode of the first transistor T111 is equal to a result of subtracting the sum of the potential of the cathode of the organic light-emitting element 13 and the threshold voltage of the organic light-emitting element 13 from the potential of the reference signal VREF. The result of subtracting the sum of the potential of the cathode of the organic light-emitting element 13 and the threshold voltage of the organic light-emitting element 13 from the potential of the reference signal VREF is smaller than zero. The first transistor T111 is an N-type transistor. Therefore, the first transistor T111 is turned off in response to the gate-source voltage being lower than zero. Thus, the on/off state of the first transistor T111 may indicate whether the organic light-emitting element 13 is short-circuited.

As shown in FIG. 7 and FIG. 8, the first transistor T111, the second transistor T112, the third transistor T113, and the fourth transistor T114 are all N-type transistors, and the fifth transistor T115 is a P-type transistor.

A turn-on signal for the first transistor T111, a turn-on signal for the second transistor T112, a turn-on signal for the third transistor T113, and a turn-on signal for the fourth transistor T114 are each at a high potential. A turn-off signal for the first transistor T111, a turn-off signal for the second transistor T112, a turn-off signal for the third transistor T113, and a turn-off signal for the fourth transistor T114 are each at a low potential. A turn-on signal for the fifth transistor T115 is at a low potential, and a turn-off signal of the fifth transistor T115 is at a high potential.

Figure 9:
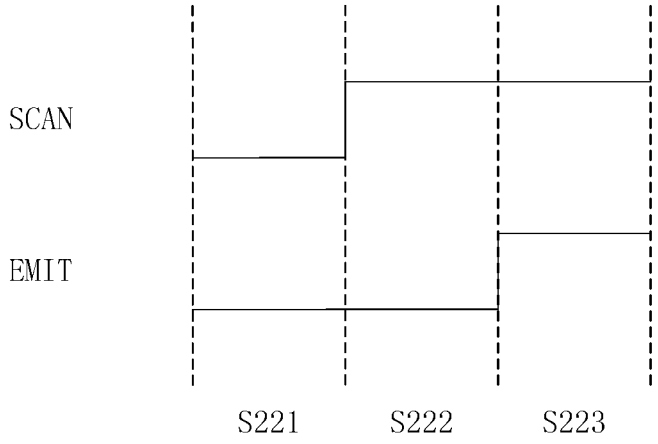
FIG. 9 shows a timing sequence of a short circuit protection circuit of a display panel according to an embodiment of the present disclosure.

FIG. 9 shows a timing sequence of a short circuit protection circuit of a display panel according to an embodiment of the present disclosure.

As shown in FIG. 7 to FIG. 9, the timing sequence of the short circuit protection circuit 11 of the display panel 1 will be described as follows.

When the organic light-emitting element 13 is not short-circuited, the first transistor T111 is turned off. A process of the first transistor T111 being turned off has been described above and will not be repeated herein.

In a first phase S221, the scan signal SCAN is at a low potential, and the light-emitting signal EMIT is at a low potential. The low potential of the scan signal SCAN controls the fourth transistor T114 to be turned off and controls the fifth transistor T115 to be turned on. The high-potential signal VGH is transmitted to the first node N111 through the fifth transistor T115, and controls the third transistor T113 to be turned on. A low potential of the light-emitting signal EMIT is transmitted to the second node N112 through the third transistor T113, and controls the second transistor T112 to be turned off.

In a second phase S222, the scan signal SCAN is at a high potential, and the light-emitting signal EMIT is at a low potential. The high potential of the scan signal SCAN controls the fourth transistor T114 to be turned on and controls the fifth transistor T115 to be turned off. The first capacitor C111 maintains the first node N111 at a high potential, and the high potential of the first node N111 controls the third transistor T113 to be turned on. The low potential of the light-emitting signal EMIT is transmitted to the second node N112 through the third transistor T113, and the low potential of the second node N112 controls the second transistor T112 to be turned off.

In a third phase S223, the scan signal SCAN is at a high potential, and the light-emitting signal EMIT is at a high potential. The high potential of the scan signal SCAN controls the fourth transistor T114 to be turned on and controls the fifth transistor T115 to be turned off. The first capacitor C111 maintains the first node N111 at a high potential, and the high potential of the first node N111 controls the third transistor T113 to be turned on. The high potential of the light-emitting signal EMIT is transmitted to the second node N112 through the third transistor T113, and the high potential of the second node N112 controls the second transistor T112 to be turned on.

Figure 10:
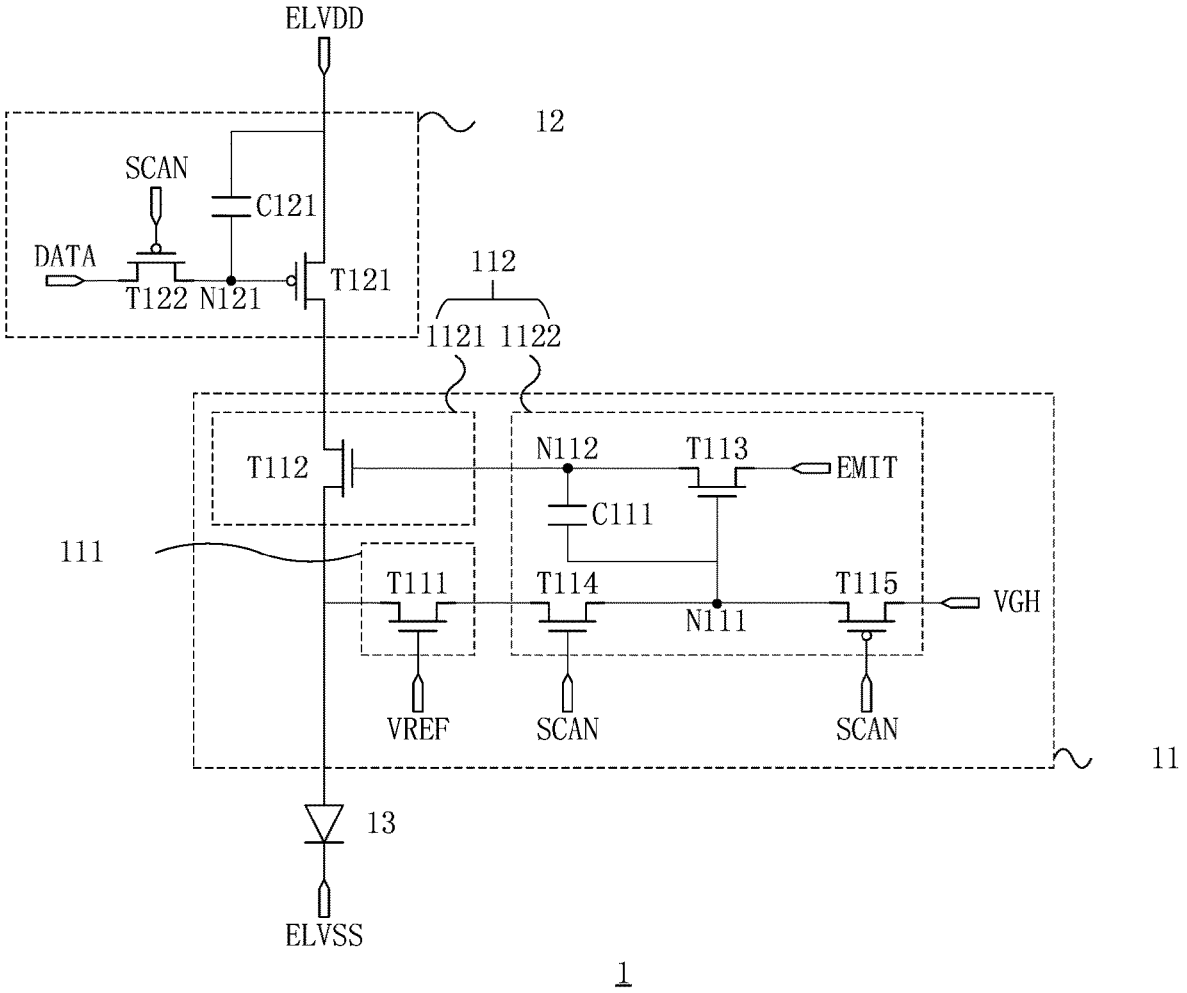
FIG. 10 is a seventh circuit diagram of a pixel unit of a display panel according to an embodiment of the present disclosure.

FIG. 10 is a seventh circuit diagram of a pixel unit of a display panel according to an embodiment of the present disclosure.

As shown in FIG. 10, the pixel driving circuit 12 includes a driving transistor T121, a switching transistor T122, a bootstrap capacitor C121, and a third node N121. The driving transistor T121 includes a control electrode electrically connected to the third node N121, a first electrode electrically connected to the first power supply signal ELVDD, and a second electrode electrically connected to the first electrode of the second transistor T112. The switching transistor T122 includes a control electrode electrically connected to the scan signal SCAN, a first electrode electrically connected to a data signal DATA, and a second electrode electrically connected to the third node N121. The bootstrap capacitor C121 includes a first electrode electrically connected to the first power supply signal ELVDD, and a second electrode electrically connected to the third node N121. The organic light-emitting element 13 includes a first electrode electrically connected to the second electrode of second transistor T112. Both the driving transistor T121 and the switching transistor T122 are P-type transistors.

A part other than the pixel driving circuit 12 in the circuit shown in FIG. 10 is the same as that in the circuit shown in FIG. 7. This part has been described above and will not be repeated herein.

The control electrode, the first electrode and the second electrode of each of the driving transistor T121 and the switching transistor T122 are respectively a gate electrode, a source electrode and a drain electrode thereof. The scan signal SCAN controls the switching transistor T122 to be turned on, and the data signal DATA is transmitted to the gate electrode of the driving transistor T121 through the switching transistor T122. The first power supply signal ELVDD is transmitted to the source electrode of the driving transistor T121. The driving transistor T121 outputs a driving current in response to the gate-source voltage of the driving transistor T121 being greater than the threshold voltage of the driving transistor T121. As described above, when the organic light-emitting element 13 is not short-circuited, the second transistor T112 may be turned on. The driving current of the driving transistor T121 is transmitted to the organic light-emitting element 13 through the second transistor T112. As a result, the organic light-emitting element 13 emits light, and the display panel 1 displays an image.

Figure 11:
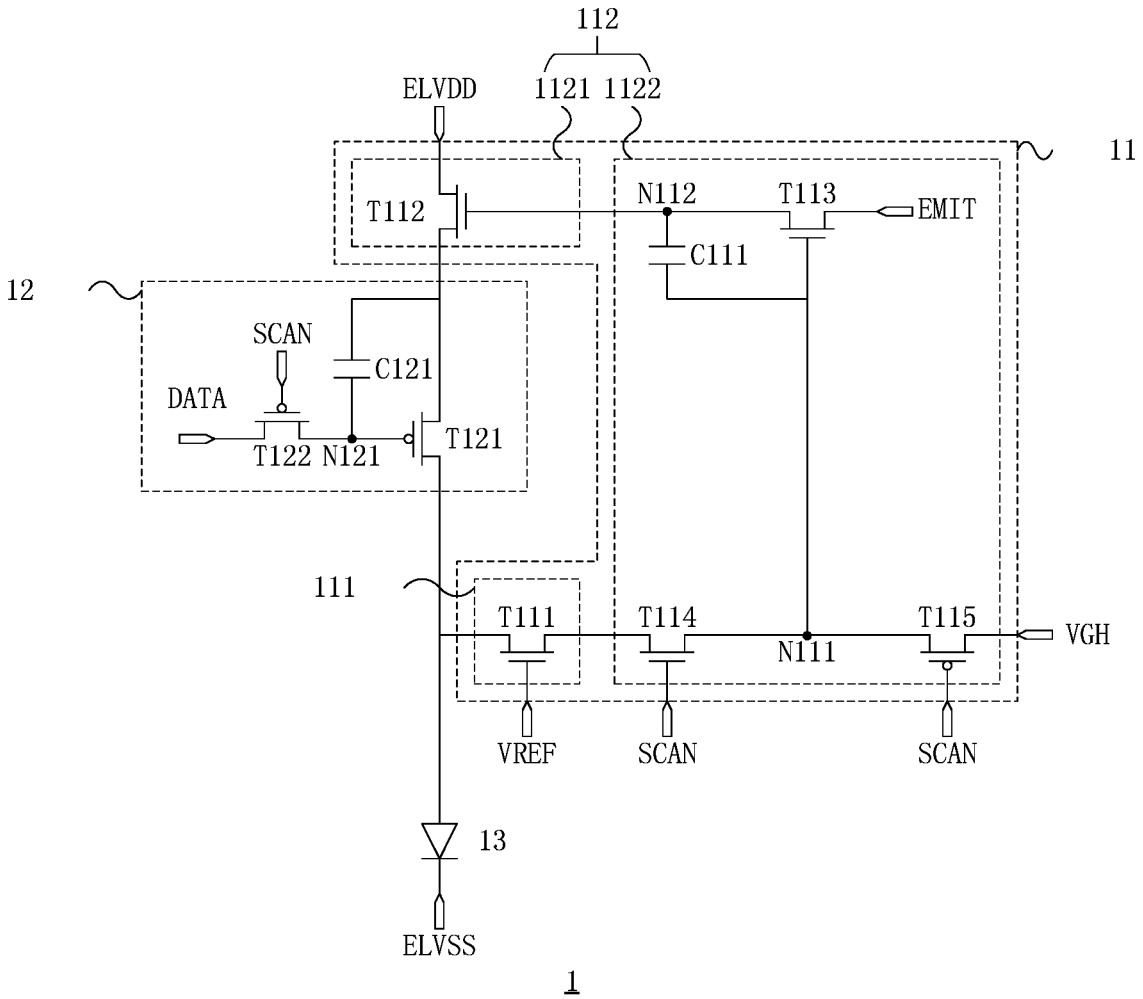
FIG. 11 is an eighth circuit diagram of a pixel unit of a display panel according to an embodiment of the present disclosure.

FIG. 11 is an eighth circuit diagram of a pixel unit of a display panel according to an embodiment of the present disclosure.

As shown in FIG. 11, the pixel driving circuit 12 includes a driving transistor T121, a switching transistor T122, a bootstrap capacitor C121, and a third node N121. The driving transistor T121 includes a control electrode electrically connected to the third node N121, a first electrode electrically connected to the second electrode of the second transistor T112, and a second electrode electrically connected to the anode of the organic light-emitting element 13. The switching transistor T122 includes a control electrode electrically connected to the scan signal SCAN, a first electrode electrically connected to the data signal DATA, and a second electrode electrically connected the third node N121. The bootstrap capacitor C121 includes a first electrode electrically connected to the second electrode of the second transistor T112, and a second electrode electrically connected to the third node N121. Both the driving transistor T121 and the switching transistor T122 are P-type transistors.

A part other than the pixel driving circuit 12 in the circuit shown in FIG. 11 is the same as that in the circuit shown in FIG. 8. This part has been described above and will not be repeated herein.

The control electrode, the first electrode and the second electrode of each of the driving transistor T121 and the switching transistor T122 are respectively a gate electrode, a source electrode and a drain electrode thereof. The scan signal SCAN controls the switching transistor T122 to be turned on, and the data signal DATA is transmitted to the gate electrode of the driving transistor T121 through the switching transistor T122. As described above, when the organic light-emitting element 13 is not short-circuited, the second transistor T112 may be turned on. The first power supply signal ELVDD is transmitted to the source electrode of the driving transistor T121 through the second transistor T112. The driving transistor T121 outputs a driving current in response to the gate-source voltage of the driving transistor T121 being greater than the threshold voltage of the driving transistor T121. The driving current of the driving transistor T121 is transmitted to the organic light-emitting element 13. As a result, the organic light-emitting element 13 emits light, and the display panel 1 displays an image.

As shown in FIG. 9, the timing sequence of the short circuit protection method 2 for the display panel will be described as follows.

In a first phase S221, the scan signal SCAN is at a low potential, and the light-emitting signal EMIT is at a low potential.

In a second phase S222, the scan signal SCAN is at a high potential, and the light-emitting signal EMIT is at a low potential.

In a third phase S223, the scan signal SCAN is at a high potential, and the light-emitting signal EMIT is at a high potential.

The scan signal SCAN is sequentially at a low potential, a high potential, and a high potential when the organic light-emitting element 13 is short-circuited or not short-circuited. The light-emitting signal EMIT is sequentially at a low potential, a low potential, and a high potential when the organic light-emitting element 13 is short-circuited or not short-circuited. The short circuit protection circuit 11 has the same timing sequence when the organic light-emitting element 13 is short-circuited or not short-circuited. This avoids setting two timing sequences for the short circuit protection circuit 11.

Figure 12:
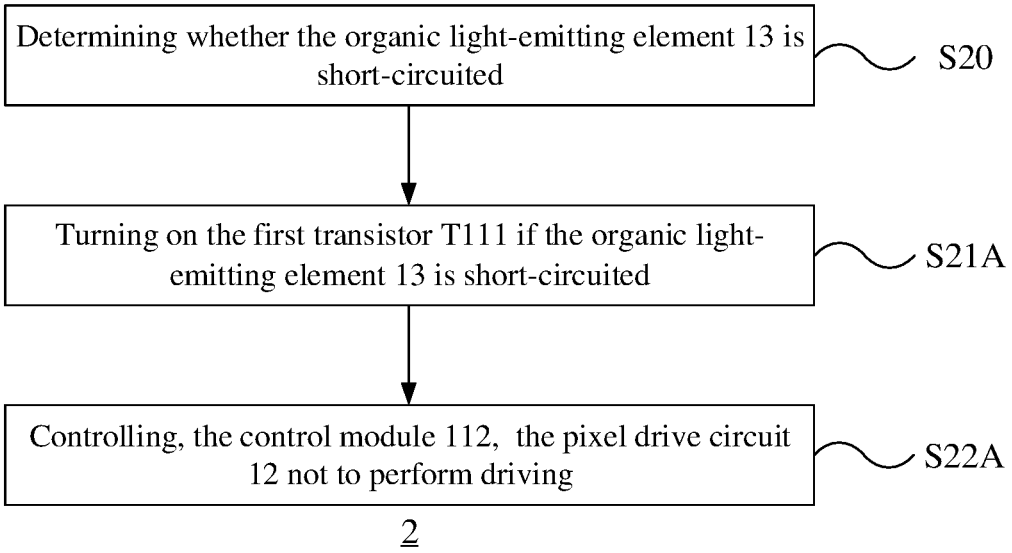
FIG. 12 is a first flow chart of a short circuit protection method for a display panel according to an embodiment of the present disclosure.

FIG. 12 is a first flow chart of a short circuit protection method for a display panel according to an embodiment of the present disclosure.

As shown in FIG. 9 to FIG. 12, the short circuit protection method 2 for the display panel is used for short circuit protection of the display panel 1. The short circuit protection method 2 for the display panel includes following steps.

At step S20, it is determined whether the organic light-emitting element 13 is short-circuited.

At step S21A, when the organic light-emitting element 13 is short-circuited, the first transistor T111 is turned on.

At step S22A, the control circuit 112 controls the pixel driving circuit 12 not to perform driving.

The first transistor T111 is configured to detect whether the organic light-emitting element 13 is short-circuited. When the organic light-emitting element 13 is short-circuited, the first transistor T111 is turned on. The first transistor T111 being turned on indicates that the organic light-emitting element 13 is short-circuited. In response to the detection result of the first transistor T111, the control circuit 112 controls the pixel driving circuit 12 not to output a driving current. In this case, the control circuit 112 prevents the driving current of the pixel driving circuit 12 from burning the organic light-emitting element 13. The driving current of the pixel driving circuit 12 does not flow through the organic light-emitting element 13, so that the organic light-emitting element 13 does not emit light.

As shown in FIG. 9 to FIG. 12, a timing sequence, based on which the control circuit 112 controls the pixel driving circuit 12 to perform driving, will be described as follows.

When the organic light-emitting element 13 is short-circuited, the potential of the anode of the organic light-emitting element 13 or the potential of the source electrode of the first transistor T111 is equal to the potential of the second power supply signal ELVSS. The potential of the gate electrode of the first transistor T111 is equal to the potential of the reference signal VREF. The gate-source voltage of the first transistor T111 is equal to the difference between the potential of the reference signal VREF and the potential of the second power supply signal ELVSS. The difference between the potential of the reference signal VREF and the potential of the second power supply signal ELVSS is greater than the threshold voltage of the first transistor T111. The first transistor T111 is an N-type transistor. Thus, the first transistor T111 is turned on in response to the gate-source voltage of the first transistor T111 being greater than the threshold voltage of the first transistor T111.

In the first phase S221, the scan signal SCAN is at a low potential, the light-emitting signal EMIT is at a low potential, the fourth transistor T114 is turned off, the fifth transistor T115 is turned on, the third transistor T113 is turned on, and the second transistor T112 is turned off.

A low potential of the scan signal SCAN controls the fourth transistor T114 to be turned off and controls the fifth transistor T115 to be turned turn on. The high-potential signal VGH is transmitted to the first node N111 through the fifth transistor T115, and controls the third transistor T113 to be turned on. A low potential of the light-emitting signal EMIT is transmitted to the second node N112 through the third transistor T113, and controls the second transistor T112 to be turned off.

In the second phase S222, the scan signal SCAN is at a high potential, the light-emitting signal EMIT is at a low potential, the fourth transistor T114 is turned on, the fifth transistor T115 is turned off, the third transistor T113 is turned off, and the second transistor T112 is turned off.

A high potential of the scan signal SCAN controls the fourth transistor T114 to be turned on and controls the fifth transistor T115 to be turned off. A low potential of the second power supply signal ELVSS is transmitted to the first node N111 through the organic light-emitting element 13, the first transistor T111, and the fourth transistor T114. The low potential of the first node N111 controls the third transistor T113 to be turned off. The first capacitor C111 maintains the second node N112 at a low potential, and the low potential of the second node N112 controls the second transistor T112 to be turned off.

In the third phase S223, the scan signal SCAN is at a high potential, the light-emitting signal EMIT is at a high potential, the fourth transistor T114 is turned on, the fifth transistor T115 is turned off, the third transistor T113 is turned off, and the second transistor T112 is turned off.

A high potential of the scan signal SCAN controls the fourth transistor T114 to be turned on and controls the fifth transistor T115 to be turned off. A low potential of the second power supply signal ELVSS is transmitted to the first node N111 through the organic light-emitting element 13, the first transistor T111, and the fourth transistor T114, and controls the third transistor T113 to be turned off. The first capacitor C111 maintains the second node N112 at a low potential, and the low potential of the second node N112 controls the second transistor T112 to be turned off.

From the first phase S221 to the third phase S223, the second transistor T112 is always turned off. As a result, the pixel driving circuit 12 does not drive the organic light-emitting element 13. Therefore, the second transistor T112 prevents the driving current of the pixel driving circuit 12 from burning the organic light-emitting element 13.

Figure 13:
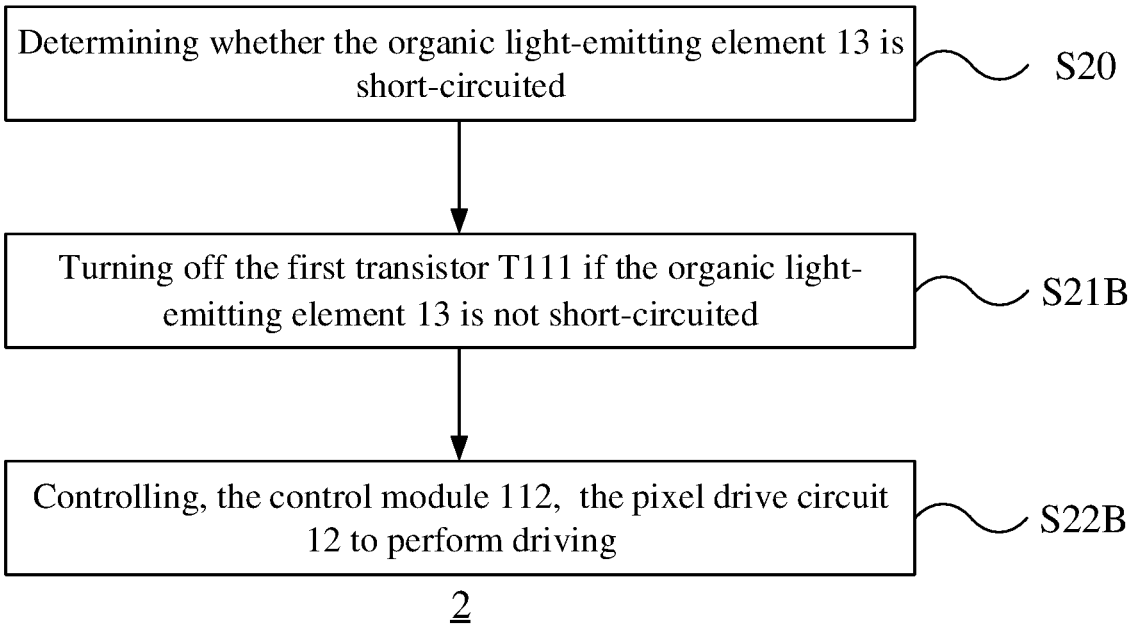
FIG. 13 is a second flow chart of a short circuit protection method for a display panel according to an embodiment of the present disclosure.

FIG. 13 is a second flow chart of a short circuit protection method for a display panel according to an embodiment of the present disclosure.

As shown in FIG. 9 to FIG. 11 and FIG. 13, a short circuit protection method 2 for the display panel is used for short circuit protection of the display panel 1.

The short circuit protection method 2 for the display panel includes following steps.

At step S21B, when the organic light-emitting element 13 is not short-circuited, the first transistor T111 is turned off.

At step S22B, the control circuit 112 controls the pixel driving circuit 12 to perform driving.

The first transistor T111 is configured to detect whether the organic light-emitting element 13 is short-circuited. When the organic light-emitting element 13 is not short-circuited, the first transistor T111 is turned off. The first transistor T111 being turned off indicates that the organic light-emitting element 13 is not short-circuited. In response to the detection result of the first transistor T111, the control circuit 112 controls the pixel driving circuit 12 to output a driving current. In this case, the pixel driving circuit 12 drives the organic light-emitting element 13 to emit light, and the display panel 1 displays an image by using the organic light-emitting elements 13.

As shown in FIG. 9 to FIG. 11 and FIG. 13, the control circuit 112 controlling the pixel driving circuit 12 to perform driving will be described as follows.

When the organic light-emitting element 13 is not short-circuited, the potential of the anode of the organic light-emitting element 13 or the potential of the source electrode of the first transistor T111 is equal to a sum of the potential of the cathode of the organic light-emitting element 13 and the threshold voltage of the organic light-emitting element 13. The potential of the gate electrode of the first transistor T111 is equal to the potential of the reference signal VREF. The gate-source voltage of the first transistor T111 is equal to a result of subtracting a sum of the potential of the cathode of the organic light-emitting element 13 and the threshold voltage of the organic light-emitting element 13 from the potential of the reference signal VREF. The result of subtracting the sum of the potential of the cathode of the organic light-emitting element 13 and the threshold voltage of the organic light-emitting element 13 from the potential of the reference signal VREF is smaller than zero. The first transistor T111 is an N-type transistor. Thus, the first transistor T111 is turned off in response to the gate-source voltage of the first transistor T111 being smaller than zero.

In the first phase S221, the scan signal SCAN is at a low potential, the light-emitting signal EMIT is at a low potential, the fourth transistor T114 is turned off, the fifth transistor T115 is turned on, the third transistor T113 is turned on, and the second transistor T112 is turned off.

A low potential of the scan signal SCAN controls the fourth transistor T114 to be turned off and controls the fifth transistor T115 to be turned on. The high-potential signal VGH is transmitted to the first node N111 through the fifth transistor T115, and controls the third transistor T113 to be turned on. A low potential of the light-emitting signal EMIT is transmitted to the second node N112 through the third transistor T113, and controls the second transistor T112 to be turned off.

In the second phase S222, the scan signal SCAN is at a high potential, the light-emitting signal EMIT is at a low potential, the fourth transistor T114 is turned on, the fifth transistor T115 is turned off, the third transistor T113 is turned on, and the second transistor T112 is turned off.

A high potential of the scan signal SCAN controls the fourth transistor T114 to be turned on and controls the fifth transistor T115 to be turned off. The first capacitor C111 maintains the first node N111 at a high potential, and the high potential of the first node N111 controls the third transistor T113 to be turned on. A low potential of the light-emitting signal EMIT is transmitted to the second node N112 through the third transistor T113, and controls the second transistor T112 to be turned off.

In the third phase S223, the scan signal SCAN is at a high potential, the light-emitting signal EMIT is at a high potential, the fourth transistor T114 is turned on, the fifth transistor T115 is turned off, the third transistor T113 is turned on, and the second transistor T112 is turned on.

A high potential of the scan signal SCAN controls the fourth transistor T114 to be turned on and controls the fifth transistor T115 to be turned off. The first capacitor C111 maintains the first node N111 at a high potential, which controls the third transistor T113 to be turned on. A high potential of the light-emitting signal EMIT is transmitted to the second node N112 through the third transistor T113, and controls the second transistor T112 to be turned on.

From the first phase S221 to the second phase S222, the second transistor T112 is turned off. In the third phase S223, the second transistor T112 is turned on. In this case, the pixel driving circuit 12 outputs a driving current. Then, the pixel driving circuit 12 drives the organic light-emitting element 13 to emit light, and the display panel 1 displays an image by using the organic light-emitting elements 13.

As shown in FIG. 9 to FIG. 12, the short circuit protection method 2 for the display panel is used for short circuit protection of the display panel 1.

The short circuit protection method 2 for the display panel includes following steps.

It is determined whether the organic light-emitting element 13 is short-circuited.

When the organic light-emitting element 13 is short-circuited, the first transistor T111 is turned on.

When the organic light-emitting element 13 is short-circuited, the potential of the anode of the organic light-emitting element 13 or the potential of the source electrode of the first transistor T111 is equal to the potential of the second power supply signal ELVSS. The potential of the gate electrode of the first transistor T111 is equal to the potential of the reference signal VREF. The gate-source voltage of the first transistor T111 is equal to the difference between the potential of the reference signal VREF and the potential of the second power supply signal ELVSS. The difference between the potential of the reference signal VREF and the potential of the second power supply signal ELVSS is greater than the threshold voltage of the first transistor T111. The first transistor T111 is an N-type transistor. Thus, the first transistor T111 is turned on in response to the gate-source voltage of the first transistor T111 being greater than the threshold voltage of the first transistor T111.

In the first phase S221, the scan signal SCAN is at a low potential, the light-emitting signal EMIT is at a low potential, the fourth transistor T114 is turned off, the fifth transistor T115 is turned on, the third transistor T113 is turned on, the second transistor T112 is turned off, and the switching transistor T122 is turned on.

A low potential of the scan signal SCAN controls the fourth transistor T114 to be turned off and controls the fifth transistor T115 to be turned on. The high-potential signal VGH is transmitted to the first node N111 through the fifth transistor T115, and controls the third transistor T113 to be turned on. A low potential of the light-emitting signal EMIT is transmitted to the second node N112 through the third transistor T113, and controls the second transistor T112 to be turned off. The low potential of the scan signal SCAN controls the switching transistor T122 to be turned on. The potential of the data signal DATA is transferred to the gate electrode of the driving transistor T121 through the switching transistor T122. The driving transistor T121 does not output a driving current, and the organic light-emitting element 13 does not emit light.

In the second phase S222, the scan signal SCAN is at a high potential, the light-emitting signal EMIT is at a low potential, the fourth transistor T114 is turned on, the fifth transistor T115 is turned off, the third transistor T113 is turned off, the second transistor T112 is turned off, and the switching transistor T122 is turned off.

A high potential of the scan signal SCAN controls the fourth transistor T114 to be turned on and controls the fifth transistor T115 to be turned off. A low potential of the second power supply signal ELVSS is transmitted to the first node N111 through the organic light-emitting element 13, the first transistor T111, and the fourth transistor T114, and controls the third transistor T113 to be turned off. The first capacitor C111 maintains the second node N112 at a low potential, which controls the second transistor T112 to be turned off. The high potential of the scan signal SCAN controls the switching transistor T122 to be turned off. The driving transistor T121 does not output a driving current, and the organic light-emitting element 13 does not emit light.

In the third phase S223, the scan signal SCAN is at a high potential, the light-emitting signal EMIT is at a high potential, the fourth transistor T114 is turned on, the fifth transistor T115 is turned off, the third transistor T113 is turned off, the second transistor T112 is turned off, and the switching transistor T122 is turned off.

A high potential of the scan signal SCAN controls the fourth transistor T114 to be turned on and controls the fifth transistor T115 to be turned off. A low potential of the second power supply signal ELVSS is transmitted to the first node N111 through the organic light-emitting element 13, the first transistor T111, and the fourth transistor T114, and controls the third transistor T113 to be turned off. The first capacitor C111 maintains the second node N112 at a low potential, which controls the second transistor T112 to be turned off. The high potential of the scan signal SCAN controls the switching transistor T122 to be turned off. The driving transistor T121 does not output a driving current, and the organic light-emitting element 13 does not emit light.

When the organic light-emitting element 13 is short-circuited, the second transistor T112 is always turned off. As a result, the driving transistor T121 does not output a driving current, and the organic light-emitting element 13 does not emit light. Thus, the second transistor T112 prevents the driving current of the pixel driving circuit 12 from burning the organic light-emitting element 13.

As shown in FIG. 9 to FIG. 11 and FIG. 13, the short circuit protection method 2 for the display panel is used for short circuit protection of the display panel 1.

The short circuit protection method 2 for the display panel includes following steps.

When the organic light-emitting element 13 is not short-circuited, the first transistor T111 is turned off.

When the organic light-emitting element 13 is not short-circuited, the potential of the anode of the organic light-emitting element 13 or the potential of the source electrode of the first transistor T111 is equal to a sum of the potential of the cathode of the organic light-emitting element 13 and the threshold voltage of the organic light-emitting element 13. The potential of the gate electrode of the first transistor T111 is equal to the potential of the reference signal VREF. The gate-source voltage of the first transistor T111 is equal to a result of subtracting a sum of the potential of the cathode of the organic light-emitting element 13 and the threshold voltage of the organic light-emitting element 13 from the potential of the reference signal VREF. The result of subtracting the sum of the potential of the cathode of the organic light-emitting element 13 and the threshold voltage of the organic light-emitting element 13 from the potential of the reference signal VREF is smaller than zero. The first transistor T111 is an N-type transistor. Thus, the first transistor T111 is turned off in response to the gate-source voltage of the first transistor T111 being smaller than zero.

In the first phase S221, the scan signal SCAN is at a low potential, the light-emitting signal EMIT is at a low potential, the fourth transistor T114 is turned off, the fifth transistor T115 is turned on, the third transistor T113 is turned on, the second transistor T112 is turned off, and the switching transistor T122 is turned on.

A low potential of the scan signal SCAN controls the fourth transistor T114 to be turned off and controls the fifth transistor T115 to be turned on. A high potential of the high-potential signal VGH is transmitted to the first node N111 through the fifth transistor T115, and controls the third transistor T113 to be turned on. A low potential of the light-emitting signal EMIT is transmitted to the second node N112 through the third transistor T113, and controls the second transistor T112 to be turned off. The low potential of the scan signal SCAN controls the switching transistor T122 to be turned on. The potential of the data signal DATA is transmitted to the gate electrode of the driving transistor T121 through the switching transistor T122.

In the second phase S222, the scan signal SCAN is at a high potential, the light-emitting signal EMIT is at a low potential, the fourth transistor T114 is turned on, the fifth transistor T115 is turned off, the third transistor T113 is turned on, the second transistor T112 is turned off, and the switching transistor T122 is turned off.

A high potential of the scan signal SCAN controls the fourth transistor T114 to be turned on and controls the fifth transistor T115 to be turned off. The first capacitor C111 maintains the first node N111 at a high potential, which controls the third transistor T113 to be turned on. A low potential of the light-emitting signal EMIT is transmitted to the second node N112 through the third transistor T113, and controls the second transistor T112 to be turned off. The high potential of the scan signal SCAN controls the switching transistor T122 to be turned off. The gate electrode of the driving transistor T121 is maintained at the potential of the data signal DATA.

In the third phase S223, the scan signal SCAN is at a high potential, the light-emitting signal EMIT is at a high potential, the fourth transistor T114 is turned on, the fifth transistor T115 is turned off, the third transistor T113 is turned on, the second transistor T112 is turned on, the switching transistor T122 is turned off, and the driving transistor T121 drives the organic light-emitting element 13 to emit light.

A high potential of the scan signal SCAN controls the fourth transistor T114 to be turned on and controls the fifth transistor T115 to be turned off. The first capacitor C111 maintains the first node N111 at a high potential, and which controls the third transistor T113 to be turned on. A high potential of the light-emitting signal EMIT is transmitted to the second node N112 through the third transistor T113, and controls the second transistor T112 to be turned on. The high potential of the scan signal SCAN controls the switching transistor T122 to be turned off. The gate electrode of the driving transistor T121 is maintained at the potential of the data signal DATA. The potential of the first power supply signal ELVDD is transmitted to the source electrode of the driving transistor T121. The driving transistor T121 outputs a driving current in response to the gate-source voltage of the driving transistor T121 being greater than the threshold voltage of the driving transistor T121. Thus, the organic light-emitting element 13 emits light, and the display panel 1 displays an image.

When the organic light-emitting element 13 is not short-circuited, the second transistor T112 is turned on in the third phase S223. Such second transistor T112 causes the driving transistor T121 to output a driving current. In view of this, the driving transistor T121 drives the organic light-emitting element 13 to emit light, and the display panel 1 displays an image by using the organic light-emitting elements 13.

The short circuit protection circuit 11 and the pixel driving circuit 12 share the scan signal SCAN. A timing sequence of the short circuit protection circuit 11 and a timing sequence of the pixel driving circuit 12 will be simplified.

Figure 14:
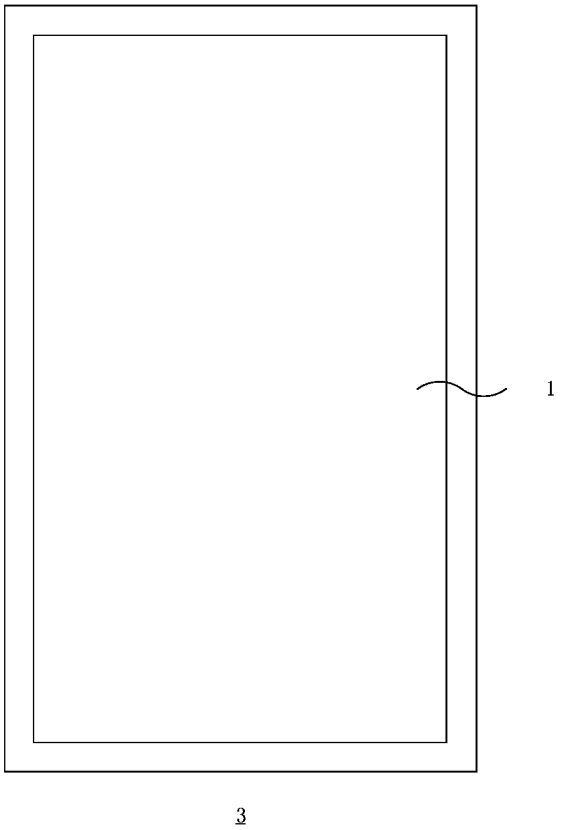
FIG. 14 is a structural schematic diagram of a display device according to an embodiment of the present disclosure.

FIG. 14 is a structural schematic diagram of a display device according to an embodiment of the present disclosure.

As shown in FIG. 14, the display device 3 includes the display panel 1.

The display device 3 achieves display by using the display panel 1. The display panel 1 has been described above and will not be further described herein.

In summary, the present disclosure provides a display panel, a short circuit protection method for the display panel, and a display device. The display panel includes a short circuit protection circuit, a pixel driving circuit, and an organic light-emitting element. The short circuit protection circuit includes a detection circuit and a control circuit. The detection circuit is electrically connected to the organic light-emitting element. The control circuit is electrically connected to the detection circuit and the pixel driving circuit. The detection circuit is configured to detect whether the organic light-emitting element is short-circuited. The control circuit is configured to control, in response to the detection result of the detection circuit, whether the pixel driving circuit performs driving. In the present disclosure, the display panel includes a plurality of pixel units that is arranged in a plurality of rows and a plurality of columns. Each pixel unit includes a short circuit protection circuit, a pixel driving circuit, and an organic light-emitting element. This prevents the pixel driving circuit from outputting an extremely large current to the organic light-emitting element that is short-circuited or other adjacent organic light-emitting element. This also prevents the pixel driving circuit from burning the organic light-emitting element that is short-circuited or other adjacent organic light-emitting element.

The above-described embodiments are merely preferred embodiments of the present disclosure and are not intended to limit the present disclosure. Any modifications, equivalent substitutions and improvements made within the principle of the present disclosure shall fall into the protection scope of the present disclosure.

What is claimed is:

1. A display panel, comprising:

a short circuit protection circuit;

a pixel driving circuit; and an organic light-emitting element, wherein the short circuit protection circuit comprises a detection circuit electrically connected to the organic light-emitting element, and a control circuit electrically connected to the detection circuit and the pixel driving circuit, the detection circuit is configured to detect whether the organic light-emitting element is short-circuited, and the control circuit is configured to control, in response to a detection result of the detection circuit, whether the pixel driving circuit performs driving;

wherein the detection circuit comprises a first transistor having a control electrode electrically connected to a reference signal, a first electrode electrically connected to the organic light-emitting element, and a second electrode electrically connected to the control circuit;

wherein the control circuit comprises a first control unit, and the first control unit comprises a second transistor having a first electrode electrically connected to the pixel driving circuit and a second electrode electrically connected to the organic light-emitting element; and wherein the control circuit further comprises a second control unit, and the second control unit comprises a third transistor, a fourth transistor, a fifth transistor, a first capacitor, a first node, and a second node, the third transistor has a control electrode electrically connected to the first node, a first electrode electrically connected to the second node, and a second electrode electrically connected to a light-emitting signal, the fourth transistor has a control electrode electrically connected to a scan signal, a first electrode electrically connected to the first transistor, and a second electrode electrically connected to the first node, the fifth transistor has a control electrode electrically connected to the scan signal, a first electrode electrically connected to the first node, and a second electrode electrically connected to a high-potential signal, and the first capacitor has a first electrode electrically connected to the second node, and a second electrode electrically connected to the first node.

2. The display panel according to claim 1, wherein the organic light-emitting element comprises a first electrode electrically connected to the first transistor, and a second electrode electrically connected to a second power supply signal, and a potential of the reference signal is greater than a sum of a potential of the second power supply signal and a threshold voltage of the first transistor, and smaller than a sum of the potential of the second power supply signal and a threshold voltage of the organic light-emitting element.

3. The display panel according to claim 2, wherein the first transistor, the second transistor, the third transistor, and the fourth transistor are all N-type transistors; and the fifth transistor is a P-type transistor.

4. The display panel according to claim 3, wherein the pixel driving circuit comprises a driving transistor, a switching transistor, a bootstrap capacitor, and a third node, the driving transistor has a control electrode electrically connected to the third node, a first electrode electrically connected to the first power supply signal, and a second electrode electrically connected to the second transistor, the switching transistor has a control electrode electrically connected to the scan signal, a first electrode electrically connected to a data signal, and a second electrode electrically connected to the third node, the bootstrap capacitor has a first electrode electrically connected to the first power supply signal, and a second electrode electrically connected to the third node, the first electrode of the organic light-emitting element is further electrically connected to the second transistor, and the driving transistor and the switching transistor are both P-type transistors.

5. The display panel according to claim 3, wherein the pixel driving circuit comprises a driving transistor, a switching transistor, a bootstrap capacitor, and a third node, the driving transistor has a control electrode electrically connected to the third node, a first electrode electrically connected to the second transistor, and a second electrode electrically connected to the organic light-emitting element, the switching transistor has a control electrode electrically connected to the scan signal, a first electrode electrically connected to a data signal, and a second electrode electrically connected to the third node, the bootstrap capacitor has a first electrode electrically connected to the second transistor, and a second electrode electrically connected to the third node, and the driving transistor and the switching transistor are both P-type transistors.

6. A display panel, comprising:

a short circuit protection circuit;

a pixel driving circuit; and an organic light-emitting element, wherein the short circuit protection circuit comprises a detection circuit electrically connected to the organic light-emitting element, and a control circuit electrically connected to the detection circuit and the pixel driving circuit, the detection circuit is configured to detect whether the organic light-emitting element is short-circuited, and the control circuit is configured to control, in response to a detection result of the detection circuit, whether the pixel driving circuit performs driving;

wherein the detection circuit comprises a first transistor having a control electrode electrically connected to a reference signal, a first electrode electrically connected to the organic light-emitting element, and a second electrode electrically connected to the control circuit; and wherein the control circuit comprises a first control unit, and the first control unit comprises a second transistor having a first electrode electrically connected to a first power supply signal and a second electrode electrically connected to the pixel driving circuit;

wherein the control circuit further comprises a second control unit, and the second control unit comprises a third transistor, a fourth transistor, a fifth transistor, a first capacitor, a first node, and a second node, the third transistor has a control electrode electrically connected to the first node, a first electrode electrically connected to the second node, and a second electrode electrically connected to a light-emitting signal, the fourth transistor has a control electrode electrically connected to a scan signal, a first electrode electrically connected to the first transistor, and a second electrode electrically connected to the first node, the fifth transistor has a control electrode electrically connected to the scan signal, a first electrode electrically connected to the first node, and a second electrode electrically connected to a high-potential signal, and the first capacitor has a first electrode electrically connected to the second node, and a second electrode electrically connected to the first node.

7. The display panel according to claim 6, wherein the organic light-emitting element comprises a first electrode electrically connected to the first transistor, and a second electrode electrically connected to a second power supply signal, and a potential of the reference signal is greater than a sum of a potential of the second power supply signal and a threshold voltage of the first transistor, and smaller than a sum of the potential of the second power supply signal and a threshold voltage of the organic light-emitting element.

8. The display panel according to claim 7, wherein the first transistor, the second transistor, the third transistor, and the fourth transistor are all N-type transistors; and the fifth transistor is a P-type transistor.

9. The display panel according to claim 8, wherein the pixel driving circuit comprises a driving transistor, a switching transistor, a bootstrap capacitor, and a third node, the driving transistor has a control electrode electrically connected to the third node, a first electrode electrically connected to the first power supply signal, and a second electrode electrically connected to the second transistor, the switching transistor has a control electrode electrically connected to the scan signal, a first electrode electrically connected to a data signal, and a second electrode electrically connected to the third node, the bootstrap capacitor has a first electrode electrically connected to the first power supply signal, and a second electrode electrically connected to the third node, the first electrode of the organic light-emitting element is further electrically connected to the second transistor, and the driving transistor and the switching transistor are both P-type transistors.

10. The display panel according to claim 8, wherein the pixel driving circuit comprises a driving transistor, a switching transistor, a bootstrap capacitor, and a third node, the driving transistor has a control electrode electrically connected to the third node, a first electrode electrically connected to the second transistor, and a second electrode electrically connected to the organic light-emitting element, the switching transistor has a control electrode electrically connected to the scan signal, a first electrode electrically connected to a data signal, and a second electrode electrically connected to the third node, the bootstrap capacitor has a first electrode electrically connected to the second transistor, and a second electrode electrically connected to the third node, and the driving transistor and the switching transistor are both P-type transistors.

* * * * *